US006688866B2

(12) United States Patent
Lambert et al.

(10) Patent No.: US 6,688,866 B2
(45) Date of Patent: Feb. 10, 2004

(54) GEROTOR PUMP WITH VARIABLE TOLERANCE HOUSING

(75) Inventors: Chris Lambert, Troy, MI (US); Mark Lemp, Sterling Heights, MI (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 10/002,866

(22) Filed: Nov. 15, 2001

(65) Prior Publication Data

US 2003/0091453 A1 May 15, 2003

(51) Int. Cl.[7] ..... F04C 2/10
(52) U.S. Cl. ..... 418/171; 418/135
(58) Field of Search ..... 418/135, 166, 418/171

(56) References Cited

U.S. PATENT DOCUMENTS

| | | | | | |
|---|---|---|---|---|---|
| 2,405,061 | A | * | 7/1946 | Shaw | 418/171 |
| 3,188,969 | A | * | 6/1965 | Brundage | 418/171 |
| 3,299,824 | A | * | 1/1967 | Gauthier | 418/135 |
| 3,632,240 | A | * | 1/1972 | Dworak | 418/135 |
| 4,540,347 | A | | 9/1985 | Child | 417/310 |
| 4,747,744 | A | | 5/1988 | Dominique et al. | 417/420 |
| 4,976,594 | A | | 12/1990 | Bernstrom | 418/61.3 |
| 5,244,367 | A | * | 9/1993 | Aslin | 418/135 |
| 5,261,803 | A | | 11/1993 | Freeman | 418/171 |
| 5,395,217 | A | | 3/1995 | Hoffmann et al. | 417/362 |
| 5,476,374 | A | | 12/1995 | Langreck | 418/171 |
| 5,554,019 | A | | 9/1996 | Hodge | 418/171 |

FOREIGN PATENT DOCUMENTS

| | | | | |
|---|---|---|---|---|
| JP | 57-76284 | * | 5/1982 | 418/135 |

* cited by examiner

*Primary Examiner*—John J. Vrablik
(74) *Attorney, Agent, or Firm*—Bliss McGlynn, P.C.; Greg Dziegielewski

(57) ABSTRACT

A gerotor pump is provided that includes a pump housing having a pump cover and a pump end plate. The pump cover defines an open end, an axial bore, and a bottom end. The pump end plate engages the open end of the pump cover thereby enclosing the axial bore of the pump cover and creating an inner cylindrical chamber in the pump housing. A wear plate and a gerotor gear set assembly are operatively disposed within the inner cylindrical chamber such that the gerotor gear set assembly is operatively disposed between the wear plate and the pump end plate. A biasing member is disposed between the bottom end of the pump cover and the wear plate, and is adapted to operatively bias the wear plate against the gerotor gear set assembly and the pump end to create an axial zero tolerance condition between the pump elements.

9 Claims, 4 Drawing Sheets

GEROTOR PUMP WITH VARIABLE TOLERANCE HOUSING

BACKGROUND OF THE INVENTION

1. Field of the Invention

The subject invention relates, generally, to gerotor pumps, more specifically to a gerotor pump having a housing that allows for variations in its internal axial tolerances.

2. Description of the Related Art

Gerotor pumps are commonly employed in the automotive industry for pumping oil to lubricate and cool various components of a typical automotive power train. For example, pumps of this type are often employed in transfer cases of automotive transmission assemblies. Gerotor pumps typically include a gerotor set having an externally toothed inner gear rotor intermeshed with an internally toothed outer gear rotor, wherein each rotor is disposed about respective eccentric axes. Other rotor pump sets are known that employ smooth surfaced rotors, one disposed within another and placed about respective eccentric axes. Regardless of the structure of the rotor set, the pumping action is accomplished by the rotational opening and closing of voids, or volumes, formed by the offset of the inner to the outer rotor during their rotation within a pump housing.

The gerotor set is typically seated in a cylindrical inner chamber of a pump housing and enclosed by an outer cover plate fixedly secured to the pump housing. A drive shaft rotates the inner rotor against the outer rotor to pump fluid between the intermeshed teeth from an inlet to an outlet in the housing.

The efficiency of the pump depends greatly upon the axial sealing of the gerotor set seated in the inner chamber between the pump housing on one axial side of the gerotor set and the outer cover plate on the other axial side of the gerotor set. The axial sealing of the gerotor set between the pump housing and the cover plate requires close manufacturing tolerances of the axial depth of the inner chamber housing the gerotor set. Such close manufacturing tolerances results in increase labor and expensive machining costs of the pump. The close tolerances also require a high torque input to initiate the rotation and pumping action of the pump elements. Additionally, in operation, when constructed with the necessary close tolerances for efficient pumping, the pump can easily exceed the desired design output pressure requiring supplemental structure for pressure relief.

Lastly, current manufacturing practices often call for the use of different materials for the pump elements and the pump housing to save weight. The use of different materials results in the undesirable effect of variations in the axial clearances as a function of temperature changes within the pump due to differing material coefficients of expansion. These temperature related changes in axial clearances, or tolerances, cause wide variations in pump performance.

Accordingly, it is desirable to provide a gerotor pump having a housing for enclosing the gerotor set which not only reduces the need for the close, exacting tolerances of prior art pumps, but also allows for variations in the thermal expansion of the pump elements while lowering the rotational torque input required to start the pump. Therefore, it is desirable to provide a gerotor pump having a variable tolerance housing.

SUMMARY OF THE INVENTION

The deficiencies in the related art are overcome by the present invention in a gerotor pump for pumping pressurized fluid between an inlet port and an outlet port. The gerotor pump includes a pump housing defined by a pump cover and a pump end plate. The pump cover defines an open end, an axial bore, a bottom end, and a central opening in the bottom end. The pump end plate is adapted to matingly engage the open end of the pump cover thereby enclosing the axial bore of the pump cover and creating an inner cylindrical chamber in the pump housing. A wear plate having a central opening is operatively disposed within the inner cylindrical chamber of the pump housing. Also, a gerotor gear set assembly having an inner and an outer rotor is disposed within the inner cylindrical chamber of the pump housing such that the gerotor gear set assembly is operatively set between the wear plate and the pump end plate. A shaft is received through the pump cover and the wear plate through the central openings and is operatively connected to the gerotor gear set assembly for rotating the gerotor gear set assembly within the inner cylindrical chamber of the pump housing. A biasing member is operatively disposed between the bottom end of the pump cover and the wear plate. The biasing member is adapted to bias the wear plate against the gerotor gear set assembly and the pump end to create an axial zero tolerance condition.

The present invention thereby overcomes the disadvantages and drawbacks of the current art by reducing the need for the close, exacting tolerances of prior art pumps, and also allows for variations in the thermal expansion of the pump elements while lowering the rotational torque input required to start the pump. This is accomplished by the variable tolerance characteristics of the pump housing that are available due to the use of the biasing member within the housing that causes the gerotor assembly to be held in zero tolerance to the other pump elements.

BRIEF DESCRIPTION OF THE DRAWINGS

Other advantages of the invention will be readily appreciated, as the same becomes better understood by reference to the following detailed description when considered in connection with the accompanying drawings, wherein.

DETAILED DESCRIPTION OF THE PREFERRED EMBODIMENT(S)

Figure 1:
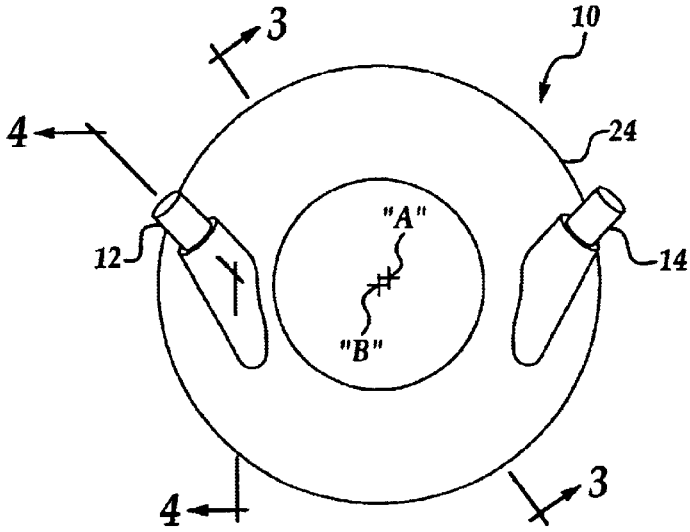
FIG. 1 is a top view of one embodiment of the gerotor pump of the present invention.
Figure 2:
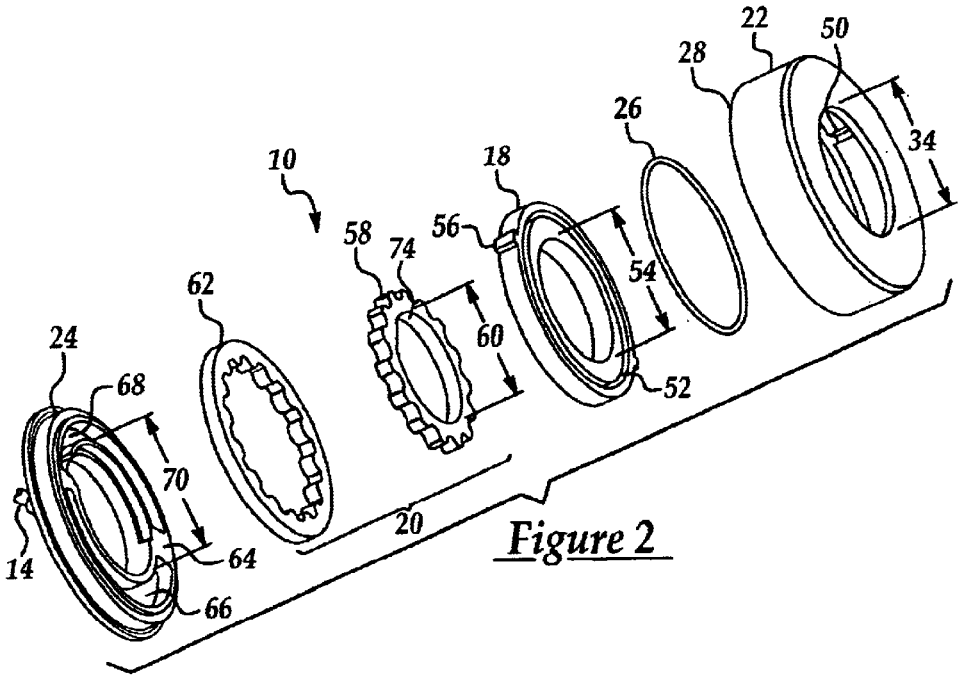
FIG. 2 is an exploded perspective view of one embodiment of the gerotor pump of the present invention.
Figure 3:
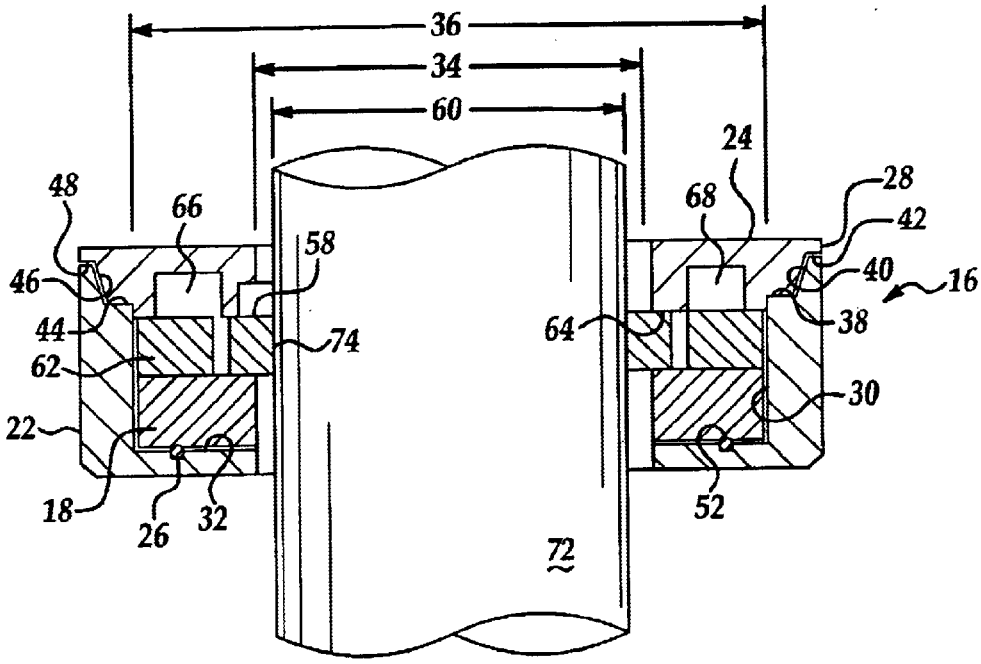
FIG. 3 is a cross-sectional view of one embodiment of the gerotor pump of the present invention taken along line 3—3 of FIG. 1.

Referring to the drawings, wherein like reference numbers represent like or corresponding parts throughout the several views, a gerotor pump according to one embodiment of the present invention is generally indicated at 10 in FIG. 1. The pump 10 is employed for pumping a fluid media, such as oil, from an inlet port 12 at a lower pressure, out through a corresponding outlet port 14 at a higher pressure. As shown in FIG. 2, the gerotor pump 10 is of a generally cylindrical disc-shaped configuration and includes a pump housing 16, a wear plate 18, a gerotor gear assembly set 20, and a biasing member 26. The pump housing 16 is defined by a pump cover 22 and a pump end plate 24.

The pump cover 22 of the pump housing 16 defines an open end 28, an axial bore 30, a bottom end 32, and a central opening 34 in the bottom end 32. The pump end plate 24 fits within, and is disposed in a mating manner against, the open end 28, thereby enclosing the axial bore 30 and creating an inner cylindrical chamber 36 within the pump housing 16. In turn, the open end 28 further defines a lower seating surface 38, an inwardly sloping sealing surface 40, and an upper seating surface 42 that concomitantly receive mating surfaces 44, 46, and 48, respectively, of the pump end plate 24, which are of similar dimensions. The axial bore 30 of the pump cover 22 also includes a plurality of retaining grooves 50 disposed axially about its circumference. When assembled, the wear plate 18, gerotor gear assembly set 20, and a biasing member 26 are disposed within the inner cylindrical chamber 36 of the pump cover 22.

The wear plate 18 has an annular groove 52, a central opening 54, and a plurality of retaining tabs 56 that extend axially along its outer circumference. The plurality of retaining tabs 56 are disposed upon the wear plate 18 in such an manner as to correspondingly engage the plurality of retaining grooves 50 in the axial wall 30 of the pump cover 22. The retaining tabs 56 and their corresponding retaining grooves 50 prevent the wear plate 18 from rotating within the inner cylindrical chamber 36, yet allow for longitudinal movement of the wear plate 18 axially within the pump housing 16.

The preferred embodiment of the present invention employs a gerotor gear set assembly 20, as is commonly known in the art. The gerotor gear set assembly 20 includes an inner toothed gear rotor 58 having a central opening 60 disposed within an outer toothed gear rotor 62. As in a typical gerotor design, the inner-toothed gear rotor 58 has one less tooth than the outer-toothed gear rotor 62, and is offset from the central axis upon which the outer-toothed rotor 62 is disposed. Thereby, the inner toothed rotor 58, in meshing relationship with the outer toothed rotor 62, forms expanding and contracting volumes or chambers between the teeth, which act as pumping chambers for the fluid media as the gerotor gear set assembly 20 is rotated. The outer-toothed gear rotor 62 is seated within the inner cylindrical chamber 36 on top of the wear plate 18 such that it is encompassed by the axial wall 30. Thus, the gerotor gear set assembly 20 is disposed between, and operatively supported by, the wear plate 18 and the pump end plate 24 within the inner cylindrical chamber 36.

The pump end plate 24 includes a flat planar surface 64 having an inlet channel 66 and an outlet channel 68 machined in a known manner therethrough. In addition, the end plate 24 further includes a central opening 70, and inlet and outlet ports 12 and 14, respectively. When the pump end plate 24 is matingly engaged to the pump cover 22, the flat planar surface 64 is seated against the gerotor gear set assembly 20. In this manner, the inlet channel 66 and the outlet channel 68 are in fluid communication with both the gerotor gear set assembly 20 and the inlet and outlet ports 12 and 14, respectively, for routing fluid media into the gerotor pump 10 at a lower pressure and out at a higher pressure.

The central openings 34, 54, and 70 of the pump cover 22, the wear plate 18, and the pump end plate 24, respectively, concomitantly allow for receiving an axial extending, cylindrical drive shaft 72 therethrough for connection to the central opening 60 of the inner rotor 58 of the gerotor gear set assembly 20. The drive shaft 72 is operatively connected in a manner commonly known in the art, using splines or the like, to the inner rotor 58 at 74.

As best shown in FIG. 1, the center axis of the pump is indicated at "A". The open end 28 and axial bore 30 of the pump cover 22 are coaxial to the center axis "A". However, the central openings 34, 54, and 70 are coaxially offset to an axis "B" which is eccentric to the center axis "A" of the pump housing 16, so that the inner rotor 58 of the gerotor gear set assembly 20 is offset relative to the outer rotor 62. This offset between the inner rotor 58 and outer rotor 62 of the gerotor pump 10 provides the desired pumping action, as described above.

The drive shaft 72 is thereby used to rotate the gerotor gear set assembly 20 within the inner cylindrical chamber 36 of the pump housing 16 to pump the fluid media from the inlet 12 to the outlet 14 of the pump end plate 24. It should be appreciated that the inlet 12 and the outlet 14 are further connected, in a known manner, in fluid communication with the next higher assembly in which the gerotor pump 10 is installed, such as a transfer case, for example.

The biasing member 26 is disposed within the annular groove 52 of the wear plate 18 such that, when the gerotor pump 10 is assembled, the biasing member 26 is in contact with both the wear plate 18 and the bottom surface 32. The annular groove 52 of the wearplate 18 retains the biasing member 26 in a coaxial position relative to the inner cylindrical chamber 36. It should be appreciated that the annular groove 52 may be disposed within either the wear plate 18, the bottom surface 32, or both to allow the biasing member 26 to be maintained in position yet contact both surfaces.

Figure 4:
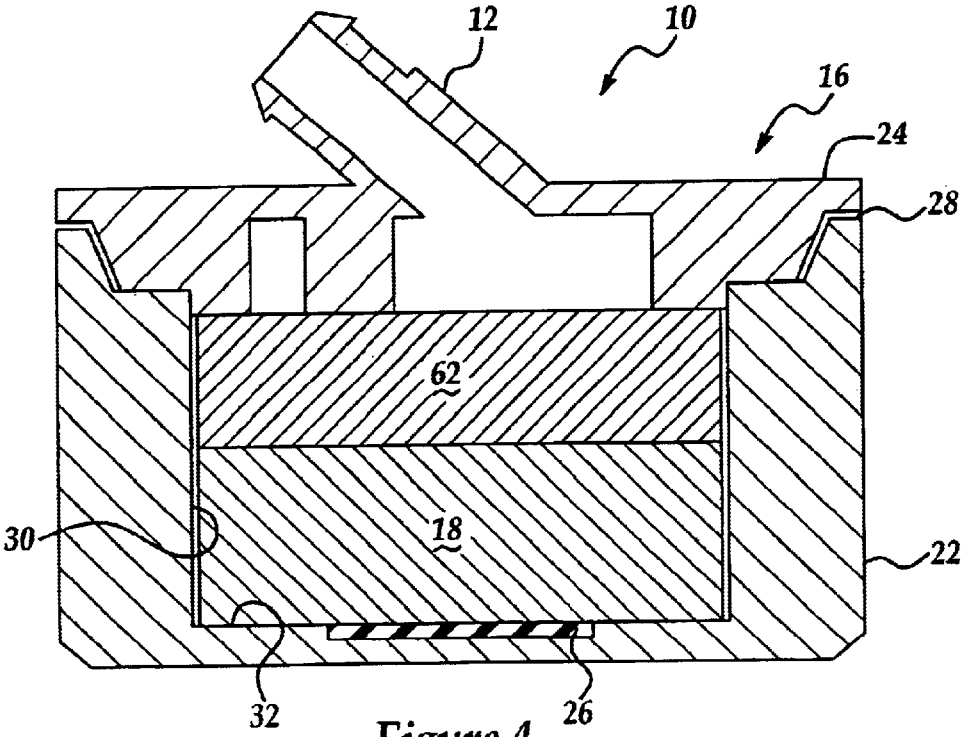
FIG. 4 is a partial cross-sectional view of one embodiment of a gerotor pump of the present invention depicting a partial section across the inlet port taken along line 4—4 of FIG. 1.

The biasing member 26, within the pump housing 16, causes the wear plate 18 to slide along the retaining grooves 50, and press the gerotor gear set assembly 20 axially against the pump end plate 24. This closes any clearances, or tolerances, between the pump elements and provides a "zero" axial tolerance condition. In the preferred embodiment, the biasing member 26 is an o-ring, manufactured of any of a group of known materials capable of maintaining high resiliency and crush resistance within a heat intensive and oil laden environment including fluorocarbon rubber or highly-saturated nitrile, for example. In another non-limiting embodiment, the biasing member 26 may be formed as a flat annular ring as shown in FIG. 4. It should additionally be appreciated by those of ordinary skill in the art that the biasing member 26 may be formed in other various cross-sectional shapes without departing from the scope or spirit of the present invention.

In operation, in an initial, static state, the biasing member 26 presses against the wear plate 18 forcing the wear plate 18 and the gerotor gear set assembly 20 against the pump end plate 24, thereby removing any axial gaps between these pump elements and holding the gerotor gear set assembly 20 to an axial "zero" clearance, or tolerance, between the wear plate 18 and the pump end plate 24. The low physical rotational drag of this configuration allows for a low torque start with high prime characteristics. In its operating capacity, the resiliency and compression characteristics of the material of the biasing member 26 may be selected to provide a specific maximum pressure capability of the gerotor pump 10. This is possible due to the fact that, as the pump pressure reaches the compression limits of the biasing member 26, the biasing member 26 will allow the wear plate 18 to slightly move away from the gerotor gear set assembly 20. As the wear plate 18 moves away from the gerotor gear set assembly 20, the axial tolerances open and the output pressure is lowered due to cross-bleeding of the gerotor gear set assembly 20. As the pressure drops, the biasing member 26 will recover and the axial tolerances will again be zeroed.

Figure 5:
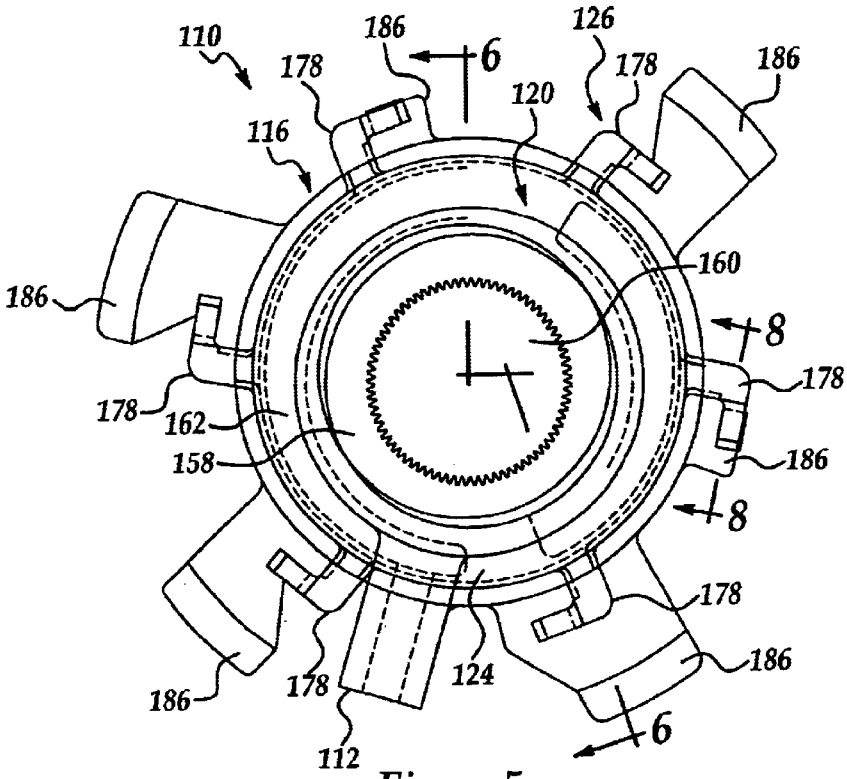
FIG. 5 is a top view of a gerotor pump and flexible cover plate according to an alternate embodiment of the present invention.
Figure 6:
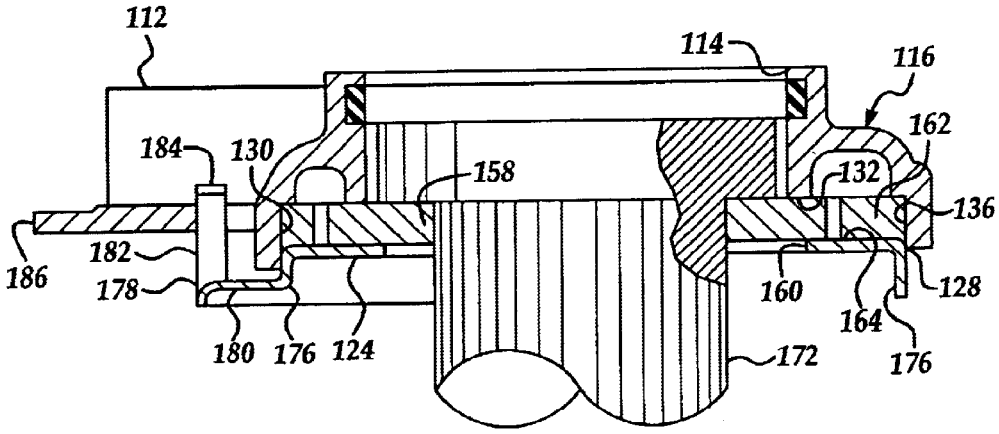
FIG. 6 is a cross-sectional view taken along line 6—6 of FIG. 5.

Another embodiment of the present invention is generally indicated at 110, in FIG. 5, wherein like reference numbers are increased by a factor of 100 are used to designate like structure with respect to the embodiment illustrated in FIGS. 1–4. The gerotor pump 110 is used for pumping pressurized fluid between an inlet 112 and an outlet 114. The gerotor pump 110 has a generally cylindrical disc-shaped configuration and includes a pump housing 116 having a cylindrical pump housing opening 128 as shown in FIG. 6. The pump housing 116 further includes an axial wall 130 defining an inner cylindrical chamber 136 and a bottom surface 132.

A gerotor gear set assembly 120 including an inner toothed gear rotor 158 and an outer toothed gear rotor 162, as is commonly known in the art, is seated within the inner cylindrical chamber 136, encompassed by the axial wall 130, and axially supported by the bottom surface 132. A longitudinal, cylindrical drive shaft 172 is operatively connected in a manner commonly known in the art to the gerotor gear set assembly 120 for rotating the gerotor gear set assembly 120 within the inner chamber 136 to pump the fluid entering the chamber 136 from the inlet 112 to the outlet 114.

The gerotor pump 110 further includes a cylindrical cover plate 124 recessed within and against the axial wall 130 and seated against the gerotor gear set assembly 120 for closing the pump housing opening 128. The cover plate 124 includes a generally flat planar surface 164 in mating engagement with the gerotor gear set assembly 120 and a center bore 160 for receiving the drive shaft 172 therethrough for connection to and rotation of the gerotor gear set assembly 120. The cover plate 124 also includes a peripheral lip 176 extending axially from the planar surface 164 which abuts and is in sealing and mating engagement with the axial wall 130 of the pump housing 116 for sealing and closing the pump housing opening 128.

The gerotor pump 110 further includes a spring bias member generally indicated at 126 interconnected between the pump housing 116 and the cover plate 124 for continuously biasing the cover plate 124 axially against the gerotor gear set assembly 120. The spring bias member 126 maintains axial bearing pressure between the cover plate 124 and the gerotor gear set assembly 120 to reduce the manufacturing tolerance typically required for proper sealing between the cover plate 124, gerotor gear set assembly 120 and axial wall 130 forming the inner chamber 136 of the pump housing 116.

Figure 7:
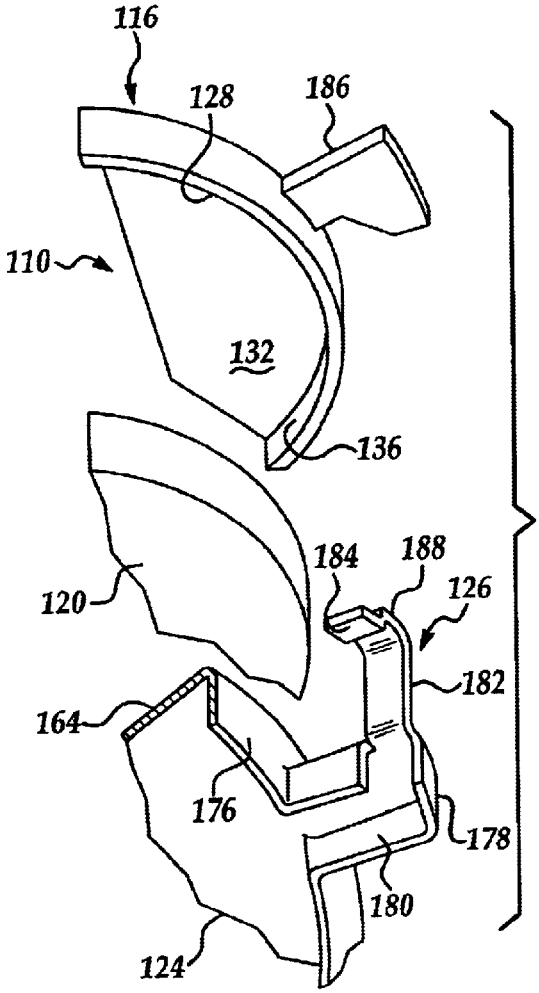
FIG. 7 is a partially exploded perspective view of the gerotor pump and flexible cover plate of the embodiment of FIG. 5.
Figure 8:
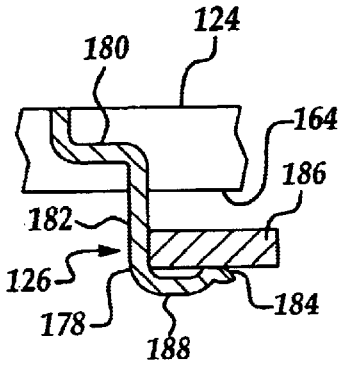
FIG. 8 is a cross-sectional view taken along line 8—8 of FIG. 5.

Referring to FIGS. 5 through 8, the spring member 126 includes a plurality of flexible locking tabs 178 spaced circumferentially about the circumference of the cover plate 124 for engaging an outer portion of the pump housing 116 to bias the cover plate 124 against the gerotor gear set assembly 120. Each flexible locking tab 178 includes a generally U-shaped base portion 180 formed integrally with the peripheral lip 176 and extending radially outwardly therefrom as shown in FIG. 7. Each flexible locking tab 178 further includes a generally L-shaped snap lock portion 182 extending axially downwardly from the base portion 180 for engaging the outer portion of the pump housing 116. Referring to FIGS. 7 and 8, the snap lock portion 182 includes a flat contact end 184 spaced from and planar to the planar surface 164 of the cover plate 124. A U-shaped torsion bar portion 188 extends between the lock portion 182 and the contact end 184 for biasing the cover plate 124 against the gerotor gear set assembly 120 in the inner chamber 136. The cover plate 124 and flexible locking tabs 178 may be an integral stamped steel solid body or solid molded plastic body.

The pump housing 116 includes a plurality of anti-rotation arms 186 formed integrally with and extending radially outwardly from the outer portion of the housing 116 for releasably locking with the respective flexible locking tabs 178 to spring bias the cover plate 124 against the gerotor gear set assembly 120. More specifically, the contact end 184 of the snap lock portion 182 engages the surface of the anti-rotation arm 186 of the pump housing 116 to releasably lock the flexible locking tabs 178 to the pump housing 116.

In assembly, the gerotor gear set assembly 120 is seated within the inner chamber 136 with the outer periphery of the gear set assembly 120 in mating engagement with a portion of the axial wall 130 of the pump housing 116 and supported by the bottom surface 132 as shown in FIG. 6. The cover plate 124 is then recessed within the pump housing opening 128 such that the peripheral lip 176 matingly engages the remaining portion of the axial wall 130 to close the opening 128 and seal the gerotor gear set assembly 120 between the bottom surface 132, axial wall 130 and planar surface 164 of the cover plate 124. The cover plate 124 is initially aligned with the pump housing 116 with each of the flexible locking tabs 178 positioned between an adjacent pair of the anti-rotation arms 186. The cover plate 124 is then rotated counterclockwise about the pump housing 116 until the contact ends 184 and torsion bar portions 188 extend over the surfaces of the anti-rotation arms 186 abutting against the leg portions 182 as shown in FIG. 8. The flexible locking tabs 178 maintain a biasing force, or tension, and sealing engagement between the cover plate 124 and the gerotor gear set assembly 120 to prevent leakage of fluid during normal operating pressures. The flexible locking tabs 178 and cover plate 124 also afford increase prime-ability of the pump 110 due to the zero tolerance between the cover plate 124, gerotor gear set assembly 120 and pump housing 116. Still further, the flexible locking tabs 178 allow the cover plate to flex or move away from the gerotor gear set assembly 120 in response to an increased fluid pressure to allow leakage across the face of the gear set assembly 120 to regulate the output pressure of the pump 110.

Figure 9:
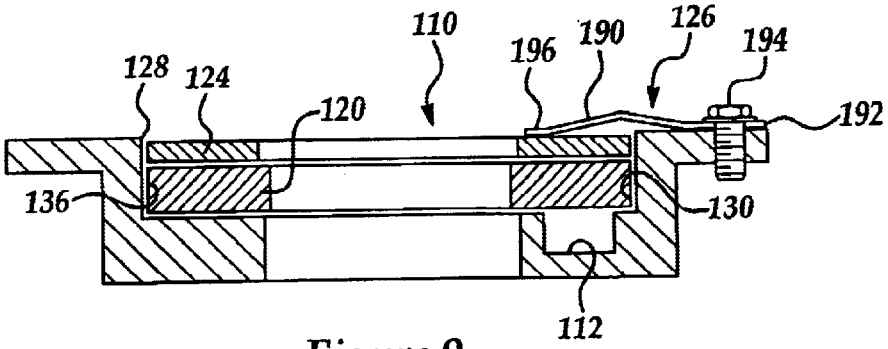
FIG. 9 is cross-sectional side view of a gerotor pump and flexible cover plate according to an additional embodiment of the present invention.

Referring to FIG. 9, an additional alternative embodiment of the present invention is shown wherein the spring bias member 126 includes a plurality of separate torsion bars 190 circumferentially spaced about the gerotor pump 110 and operatively connected between the pump housing 116 and the cover plate 124. The torsion bars 190 include a thin metal plate having a first end 192 fixedly secured to the pump housing 116 by a fastener 194 and a second end 196 in mating engagement with the cover plate 124 for urging the cover plate 124 against the gerotor gear set assembly 120 in a manner similar to the embodiment shown in FIGS. 5 through 8.

The invention has been described in an illustrative manner. It is to be understood that the terminology that has been used is intended to be in the nature of words of description rather than of limitation. Many modifications and variations of the invention are possible in light of the above teachings. Therefore, within the scope of the appended claims, the invention may be practiced other than as specifically described.

We claim:

1. A gerotor pump for pumping pressurized fluid between an inlet port and an outlet port, said gerotor pump including:

a pump housing defined by a pump cover and a pump end plate, said pump cover defining an open end, an axial bore, a bottom end, and a central opening in said bottom end, said pump end plate adapted to matingly engage said open end of said pump cover thereby enclosing said axial bore of said pump cover and creating an inner cylindrical chamber within said pump housing;

a wear plate having a central opening and operatively disposed within said inner cylindrical chamber of said pump housing;

a gerotor gear set assembly disposed within said inner cylindrical chamber of said pump housing such that said gerotor gear set assembly is operatively supported between said wear plate and said pump end plate;

a shaft operatively connected to said gerotor gear set assembly for rotating said gerotor gear set assembly within said inner cylindrical chamber of said pump housing;

a biasing member formed as a resilient annular ring that is operatively disposed between said bottom end of said pump cover and said wear plate, only said resilient annular ring adapted to operatively bias said wear plate against said gerotor gear set assembly and said pump end plate to create an axial zero tolerance condition between said wear plate, said gerotor gear set assembly, and said pump end plate.

2. A gerotor pump as set forth in claim 1 wherein said wear plate includes an annular groove disposed in its bottom surface, said biasing member adapted to be received within said annular groove.

3. A gerotor pump as set forth in claim 1 wherein said bottom surface of said pump cover includes an annular groove, said biasing member adapted to be received within said annular groove.

4. A gerotor pump as set forth in claim 1 wherein said biasing member is made from at least one of a group comprising fluorocarbon rubber or highly-saturated nitrile compounds.

5. A gerotor pump as set forth in claim 1 wherein said annular ring is further defined as an o-ring.

6. A gerotor pump as set forth in claim 1 wherein said wear plate includes a plurality of retaining tabs extending outward from the circumference of said wear plate and parallel to its central axis, and said pump cover includes a plurality of retaining grooves disposed axially along said inner bore, said retaining tabs adapted to slidingly engage said retaining grooves such that said wear plate is free to move axially within said pump cover but is prevented from rotating.

7. A gerotor pump as set forth in claim 1 wherein said gerotor gear set assembly includes an inner pumping gear element having external teeth interposed in meshing relationship with an outer pumping gear element having internal teeth, said inner pumping gear element operatively disposed on a central pump axis defined by center axis of said pump housing, said outer pumping gear element operatively disposed on an axis that is offset relative to said central pump axis so that rotation of said inner and outer pumping gear elements, relative to one another, creates gaps between said internal and external teeth which define expanding and contracting pumping volumes.

8. A gerotor pump as set forth in claim 1 wherein said pump end plate includes a planar surface in contact engagement with said gerotor gear assembly, said planar surface including an inlet passage and an outlet passage in fluid communication with said pumping volumes of gerotor gear set assembly.

9. A gerotor pump as set forth in claim 1 wherein said pump end plate includes an inlet port in fluid communication with said inlet port and an outlet port in fluid communication with said outlet passage such that said inlet port delivers fluid media at a lower pressure to said gerotor gear set assembly and said outlet port receives fluid media at a higher pressure from said gerotor gear set assembly.

* * * * *